US010920375B2

(12) United States Patent
Hemmes et al.

(10) Patent No.: US 10,920,375 B2
(45) Date of Patent: Feb. 16, 2021

(54) METHOD FOR INCREASING DIMENSIONAL STABILITY OF A PAPER OR A BOARD PRODUCT

(71) Applicant: Kemira Oyj, Helsinki (FI)

(72) Inventors: Jan-Luiken Hemmes, Bergisch Gladbach (DE); Jonathan (Yingshuang) Wei, Shanghai (CN); Rongjun Lu, Shanghai (CN)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 16/335,610

(22) PCT Filed: Sep. 19, 2017

(86) PCT No.: PCT/EP2017/073592

§ 371 (c)(1),
(2) Date: Mar. 21, 2019

(87) PCT Pub. No.: WO2018/060002

PCT Pub. Date: Apr. 5, 2018

(65) Prior Publication Data

US 2019/0301100 A1 Oct. 3, 2019

(30) Foreign Application Priority Data

Sep. 30, 2016 (CN) ..... 2016 1 0922522
Oct. 19, 2016 (FI) ..... 20165795

(51) Int. Cl.

| | |
|---|---|
| ***D21H 17/55*** | (2006.01) |
| ***D21H 21/20*** | (2006.01) |
| ***D21H 21/16*** | (2006.01) |
| ***D21H 17/62*** | (2006.01) |
| ***D21H 11/04*** | (2006.01) |
| ***D21J 3/00*** | (2006.01) |
| ***D21H 23/04*** | (2006.01) |
| ***D21H 17/57*** | (2006.01) |
| ***D21H 17/17*** | (2006.01) |
| ***D21H 17/52*** | (2006.01) |
| ***D21H 17/54*** | (2006.01) |
| ***D21H 21/18*** | (2006.01) |

(52) U.S. Cl.

CPC ..... *D21H 17/55* (2013.01); *D21H 11/04* (2013.01); *D21H 17/17* (2013.01); *D21H 17/52* (2013.01); *D21H 17/54* (2013.01); *D21H 17/57* (2013.01); *D21H 17/62* (2013.01); *D21H 21/16* (2013.01); *D21H 21/18* (2013.01); *D21H 21/20* (2013.01); *D21H 23/04* (2013.01); *D21J 3/00* (2013.01)

(58) Field of Classification Search

None

See application file for complete search history.

(56) References Cited

U.S. PATENT DOCUMENTS

| | | | | |
|---|---|---|---|---|
| 5,017,642 | A * | 5/1991 | Hasegawa | C08G 69/48 524/606 |
| 5,427,652 | A | 6/1995 | Darlington et al. | |
| 5,667,637 | A * | 9/1997 | Jewell | C08B 11/12 162/146 |
| 6,143,132 | A | 11/2000 | Träubel et al. | |
| 2003/0131962 | A1* | 7/2003 | Lindsay | D21H 21/18 162/168.2 |
| 2004/0256065 | A1 | 12/2004 | Ahmed et al. | |
| 2007/0087190 | A1 | 4/2007 | Akiyama et al. | |
| 2014/0069600 | A1 | 3/2014 | Furman, Jr. et al. | |
| 2015/0111997 | A1* | 4/2015 | Mesic | B29C 70/12 524/35 |

FOREIGN PATENT DOCUMENTS

| | | | |
|---|---|---|---|
| JP | 2003027390 | A | 1/2003 |
| SU | 1444451 | A1 | 12/1988 |
| WO | 2013169203 | A1 | 11/2013 |
| WO | 2015167440 | A1 | 11/2015 |

OTHER PUBLICATIONS

Smook, Gary A., Handbook for Pulp and Paper Technologists, 2nd ed, Angus Wilde Publications, 1992, p. 228. (Year: 1992).*

Finnish Patent and Registration Office, Search report of Finnish patent application No. 20165795, dated May 11, 2017, 2 pages.

* cited by examiner

*Primary Examiner* — Dennis R Cordray
(74) *Attorney, Agent, or Firm* — Berggren LLP

(57) ABSTRACT

The present invention relates to a process for producing a paper or a board product having increased dimension stability including providing a fibre slurry including never-dried fibres, treating the fibre slurry with a strength composition, and forming a paper or a board product from the treated fibre slurry, where the strength composition includes a permanent wet strength resin component and a sizing agent. The present invention further relates to a use of a strength composition for increasing dimensional stability of a paper and a board, and to a paper or a board product having improved dimensional stability.

20 Claims, No Drawings

METHOD FOR INCREASING DIMENSIONAL STABILITY OF A PAPER OR A BOARD PRODUCT

PRIORITY

This application is a U.S. national application of the international application number PCT/EP2017/073592 filed on Sep. 19, 2017 and claiming priority of Chinese national application CN201610922522.6 filed on Sep. 30, 2016 and Finnish national application FI20165795 filed on Oct. 19, 2016 the contents of all of which are incorporated herein by reference.

FIELD OF THE INVENTION

The present invention relates to a process for producing a paper or a board product having increased dimension stability. The present invention further relates to a use of a strength composition for increasing dimensional stability of a paper and a board, and to a paper and a board product having improved dimensional stability.

BACKGROUND ART

The cellulose fibres comprised in a sheet or web of paper or board have an affinity for water, which means that they readily absorb water from the atmosphere or lose water to the atmosphere, depending on the relative humidity and the equilibrium moisture content of the paper. When cellulose fibres absorb water, they expand primarily in width, but only slightly in length. Similarly, when a paper loses moisture to the atmosphere, the fibres will shrink primarily in width, but only slightly in length. Therefore, when a paper undergoes a dimensional change, it will primarily be in the cross-grain direction.

As cellulose fibres have affinity for water and may swell under the influence of water, the dimensions and/or shape of a paper or board sheet or web may change when its moisture content changes. This can occur because of the changes in the ambient air humidity in the case of packaging board and paper, because of water application such as in offset printing, or because of heating for example in copying machines. Dimensional changes in paper caused by water and heating in offset printing and in digital printing are primarily due to differences in fibre orientation angle between the two sides of paper or between the centre and areas close to the edges of the paper web in the paper machine. Good dimensional stability is necessary in all board and paper grades whose moisture content may change.

Few examples of paper and board products that are sensitive to issues of dimensional stability are wall papers and gypsum boards.

The addition of fillers to the papermaking slurry helps increase a paper's dimensional stability, as fillers do not absorb or lose moisture. The extent to which a paper's fibres have been refined, i.e., how short and how closely bonded the fibres are in the paper, also affects its dimensional stability; the less refined the fibres are, the greater the dimensional instability.

It is evident that there is a constant need for improving dimensional stability of paper and board products, especially of paper and board products that are subjected to extensive moisture changes.

SUMMARY OF INVENTION

An object of the present invention is to minimize or possibly even eliminate the disadvantages existing in the prior art.

A further object of the present invention is to provide a process for producing a paper or a board product having increased dimension stability.

Yet, a further object of the present invention is to provide a simple and cost-effective process for producing of a paper or a board product having increased dimension stability.

Yet, a further object of the present invention is to provide a method of increasing wet strength of a paper or a board product.

Yet, a further object of the present invention is to provide a paper or a board product having reduced wet expansion and improved hydrophobicity.

These objects are attained with the invention having the characteristics presented below in the characterizing parts of the independent claims. Some preferred embodiments of the invention are presented in the dependent claims.

The paper or board product is produced in a conventional manner using conventional equipments.

A typical process according to the present invention for producing a paper or a board product having increased dimension stability comprises providing a fibre slurry comprising never-dried fibres, treating the fibre slurry with a strength composition, introducing the treated fibre slurry to forming section for producing web, introducing the web into press section for producing a paper or a board product, wherein the strength composition comprises a permanent wet strength resin component and a sizing agent, and amount of the never-dried fibres in the fibre slurry is at least 15 weight-% based on the total dry weight of the fibre slurry.

In a typical use according to the present invention for increasing dimensional stability of a paper and a board product the strength composition comprises a permanent wet strength resin component and a sizing agent, and the paper and the board products are produced from a fibre slurry comprising never-dried fibres.

Typical paper or board product according to the present invention has improved dimensional stability, wherein the paper or board product is produced by a method according to the present invention, and has a wet expansion, as measured according to EMCO (15 min), reduced by at least 10%, more preferably by at least 15%, most preferably by at least 20% compared to a paper or board not comprising a strength composition comprising a permanent wet strength resin component and a sizing agent.

Now it has been surprisingly found that the wet dimensional stability of a final paper or board product is significantly improved when a strength composition comprising a permanent wet strength resin component and a sizing agent is added to the fibre slurry comprising never-dried fibres, such as Kraft fibres, before the formation of the paper or the board web.

Papers made using never-dried, virgin cellulose fibres have better tensile strength compared to papers made from dried cellulose fibres. On the other hand, dried fibres provide improved dewatering to the papermaking process compared to never-dried fibres. Both of these effects originate from hornification of the cellulose fibres during drying. The strength loss of the dried fibres may be overcome by increased refining, so the dried fibres may eventually provide better combination of tensile strength and dewatering, compared to never-dried fibres. Dried fibres also swell less, so papers made therefrom are less vulnerable to dimensional instability compared to never-dried fibres. However, drying involves high energy consumption, and adds complexity of the papermaking process by requiring additional process steps and equipment. Additionally, the increased refining of the dried fibres needed for reaching the desired tensile strength level, also increases energy consumption. Never-dried fibres are available in integrated pulp&paper mills where additional benefit comes from energy etc. savings as the pulp do not need to be dried for transportation.

It is assumed without wishing to be bound by a theory that the addition of the strength composition according to the present invention into the fibre slurry comprising never-dried cellulose fibres provides optimal combination of strength and hydrophobicity to the fibre web being formed, as well as improved dewatering. Furthermore the strength composition improves the fibre-fibre interaction and holding of the fibres together, and enables better strength properties and higher hydrophobicity also in the final paper or board product. Also the dimensional stability of the final paper or board product is increased, which can be seen especially as decreased wet expansion of the produced paper or board.

DETAILED DESCRIPTION

According to the first aspect of the present invention there is provided a process for producing a paper or a board product having increased dimension stability. More particularly there is provided a process for producing a paper product or a board product having increased dimension stability comprising

- providing a fibre slurry comprising never-dried fibres,
- treating the fibre slurry with a strength composition,
- introducing the treated fibre slurry to forming section for producing web,
- introducing the web into press section for producing a paper or a board product, wherein the strength composition comprises a permanent wet strength resin composition and a sizing agent, and wherein amount of the never-dried fibres in the fibre slurry is at least 15 weight-% based on the total dry weight of the fibre slurry.

The paper or board product is preferably a paper or board, which is subjected to an aqueous composition either during manufacturing, post-processing or when in use. Such aqueous composition may be, for example, a coating composition, glue, ink or gypsum slurry. Specific examples of such paper products are gypsum paper; wall paper; coated paper; printing paper, such as industrial printing paper and inkjet paper; and copy paper, such as laser copy paper. Specific examples of such board products are gypsum board; coated board; and glued board. Examples of board products include, for example, packaging board grades and container-board grades, such as sized grades of kraftliners and testliners.

The fibre slurry may be obtained by mixing cellulose fibre material into water. The fibre slurry may comprise fibre material originating from bleached or unbleached Kraft fibres, and optionally internal paper/board machine broke, and/or recycled fibre material. The recycled fibre material may originate, for example, from old corrugated cardboard (OCC), old magazines, old newspapers, mixed office waste (MOW), or mixed household waste. The fibre slurry may also comprise added fillers such as calcium carbonate $CaCO_3$, like ground calcium carbonate, GCC or precipitated calcium carbonate, PCC.

In the present context the term "never-dried fibre" means a cellulose fibre in a wet state, as it is obtained from a chemical pulping process, without drying prior its to use in the paper or board manufacture. Never-dried fibres are typically used in so-called integrated pulp and paper mills, where never-dried pulp is easily available. Especially never-dried fibres are used for enforcing packaging paper and board grades.

The never-dried fibres may be obtained by any chemical pulping process, and preferably by Kraft pulping process including sulphate pulping and sulphite pulping, more preferably by Kraft pulping process including sulphate pulping.

In one embodiment the never-dried fibres are Kraft fibres. The never-dried fibres may be bleached or unbleached, unbleached Kraft fibres being preferable. Unbleached never-dried Kraft fibres are preferable e.g. in gypsum board applications, while bleached never-dried Kraft fibres are preferable e.g. in high quality paper grades such as graphical paper grades.

Amount of the never-dried fibres in the fibre slurry may be at least 15 weight-%, preferably 15-90 weight-%, more preferably 30-70 weight-%, even more preferably 40-60 weight-%, based on the total dry weight of the fibre slurry. Papers and board made using never-dried fibre have better tensile strength compared to papers made from dried cellulose fibres.

In the present invention optimal combination of tensile strength and dimensional stability of a final paper or board product is obtained when the strength composition comprising the permanent wet strength resin component and the sizing agent is added to fibre slurry comprising the never-dried fibres, while substantially not hindering the manufacturing process, especially dewatering, or even improving it.

By the term "permanent wet strength resin component" is meant chemicals improving the tensile properties of the paper or board both in wet and dry state by crosslinking the cellulose fibres with covalent bonds that do not break upon wetting. Although the term "permanent wet strength resin component" is not meant to cover temporary wet strength resins or agents, the presence of temporary wet strength resins or agents in the paper or board manufacture is not excluded.

The permanent wet strength resin component may be a cross-linking resin. Cross-linking resins form a network in a cellulose fibre web that provides strength when the paper or board becomes wet. Cross-linking resins may also reinforce existing fibre-to-fibre bonds, further enhancing the strength of the paper or board product. Preferably the permanent wet strength resin component may be selected from polyamido-amine-epihalohydrin (PAE) resins, polydiisocyanate resins, urea-formaldehyde (UF) resins, melamine formaldehyde (MF) resins, polydiisocyanate (DI) resins and mixtures thereof. It has been observed that especially poly-amidoamine-epihalohydrin resins and polydiisocyanate resins provide improved properties, especially improved wet dimensional stability. Beyond reinforcing the sheet permanent wet strength resin components may play an important role in balancing charge on fines and fibres, providing benefits for improving retention and/or efficiency of other process and functional additives, such as the sizing agent, and improving sheet dewatering.

Preferably the permanent wet strength resin component is polyamidoamine-epichlorohydrin resin.

According to one preferable embodiment of the present invention the permanent wet strength resin component is a self-crosslinking polyamidoamine-epihalohydrin resin. Polyamidoamine-epihalohydrin resins are based on a polyamidoamine backbone, which is a result of a condensation reaction between adipic acid and diethylenetriamine. A subsequent reaction with epihalohydrin results a cross-linked polymer resin structure, where highly reactive azetidinium groups are created along the polymer backbone. The amount of azetidinium groups may be controlled by careful selection, for example, of the epihalohydrin/amine ratio. According to one exemplary embodiment, the polyamidoamine-epihalohydrin resin has a molar ratio of epihalohydrin to secondary amine group at least 0.8. In some embodiments the molar ratio of epihalohydrin to secondary amine group can be 0.8-3.0, such as 0.9-2.5, or 1.0-2.0, or 1.1-1.7, or 1.2-1.5, or 1.25-1.45.

Suitable polyamidoamine-epihalohydrin resins may have a weight average molecular weight in the range of 80 000-250 000 g/mol, preferably 150 000-250 000 g/mol. It is believed that polyamidoamine-epihalohydrin resins having said molecular weights are more effective in reducing the wet expansion of the paper or board. The molecular weight may be determined by size exclusion chromatography, such as GPC.

As described above polyamidoamine-epihalohydrin resin comprises reactive azetidinium groups, which provide the resin with a high cationic charge, which improves the retention of the resin to the fibres and provides the resin with a self-crosslinking ability. Preferably the polyamidoamine-epihalohydrin resin has a charge density of 1.5-4.5 meq/g, preferably 2.0-4.0 meq/g, more preferably 2.1-3.0 meq/g, determined at pH 7 by titration with potassium salt of polyvinylsulfate. When retained in the fibre web the polyamidoamine-epihalohydrin resin self-crosslinks and forms a strong protection around fibre-fibre bonds and prevents the bonds from hydrolysing.

According to another preferable embodiment the permanent wet strength resin component is a polydiisocyanate resin. Polydiisocyanate resin is preferably used in form of an aqueous emulsion in order to provide an even distribution of the resin to the fibre slurry. Polydiisocyanate resin may comprise aliphatic, cycloaliphatic or aromatic polydiisocyanate, or mixtures thereof. Suitable polydiisocyanates may comprise, preferably, more than 2 isocyanate groups, for example 2 to 5 isocyanate groups. Preferable examples of polydiisocyanate resins are based on diphenylmethane diisocyanate, toluene diisocyanate, hexamethylene diisocyanate or isophorone diisocyanate chemistry, or a mixture thereof. The amount of reactive isocyanate groups, i.e. NCO-content, may vary in the range of 5-50%, typically 7-25%.

The sizing agent is preferably selected from alkylene ketene dimer (AKD), alkyl succinic anhydride (ASA), rosin derivative, or a mixture thereof. The synthetic sizing agents, AKD, ASA and rosin derivatives, are more stable and of homogeneous quality, compared to natural sizing agents, and also more cost-efficient to use.

Typical dosage of sizing agent may vary depending on the sizing agent used and the paper or board grade being manufactured. Typical minimum dosage of a sizing agent to a fiber slurry is at least 0.3 kg/ton of fibre slurry calculated as dry, especially for AKD or ASA sizing agents. More typical minimum dosage of a sizing agent for a rosin derivative type is at least 2 kg/ton of fibre slurry calculated as dry. Preferably the sizing agent is added to the fiber slurry in an amount of at least 0.5 kg/ton, more preferably at least 1 kg/ton, most preferably at least 3 kg/ton, of fibre slurry calculated as dry.

The sizing agent may be added in amount of providing to the paper or board a Cobb60 value of at most 70 g/m$^2$, preferably at most 50 g/m$^2$, more preferably at most 40 g/m$^2$, as measured according to ISO 535. The paper or board product may have a Cobb60 value in the range of 18-70 g/m$^2$, for example in the range of 20-50 g/m$^2$. For printing paper a preferred Cobb60 value may be 40-70 g/m$^2$. For sized containerboard grades and gypsum paper or board a preferred Cobb60 value may be 20-50 g/m$^2$. The Cobb60 value may be further improved by additional surface treatments applied to a paper or board surface.

According to one preferable embodiment of the present invention the strength composition is added in such amount that the zeta potential of the fibre slurry remains negative, preferably <−2.0 mV after the addition of the strength composition. When the zeta potential approaches too close to neutral value, foaming may become a problem. Therefore it is preferred that the strength agent composition is added in such amount that the zeta potential of the fibre slurry remains <−3.0 mV, more preferably <−5 mV, even more preferably <−10 mV after the addition of the strength composition.

In one embodiment the strength composition is added in amount that results 0.1-30 kg of permanent wet strength resin component/ton dry fibre slurry, preferably 0.25-18.2 kg permanent wet strength resin component/ton dry fibre slurry, more preferably 0.5-5.0 kg permanent wet strength resin component/ton dry fibre slurry, calculated as dry permanent wet strength resin component. It was unexpectedly observed that the improvement in wet dimensional stability and physical strength of the paper and board products can be achieved even with relative low dosage of the strength composition. This is advantageous, not only because thus the above-mentioned problems associated with neutral zeta potential values may be avoided, but also because the chemical costs may be minimized in the process.

According to one preferred embodiment the strength composition comprises anionic polyacrylamide. The anionic polyacrylamide may improve the retention of the permanent wet strength resin component, preferably polyamidoamine-epihalohydrin resin, to the fibres. The ratio of the anionic polyacrylamide and polyamidoamine-epihalohydrin resin may be about 0.05 to 1.

According to one embodiment of the invention the permanent wet strength resin component and the sizing agent of the strength composition are added separately to the fibre slurry. Thus the permanent wet strength resin component and the sizing agent of the strength composition may be added at different times, i.e. they are not added at the same time. According to one preferable embodiment of the invention the permanent wet strength resin component is added to the fibre slurry prior to the addition of the sizing agent, because the sizing agent has higher reactivity than the permanent wet strength resin component. The sizing agent may lose its efficiency if added too early in the process.

Alternatively the sizing agent may be added prior to the addition of the permanent wet strength resin component.

According to another embodiment the permanent wet strength resin component and the sizing agent may be added simultaneously to the fibre slurry. This means that the permanent wet strength resin component and the sizing agent are added to the fibre slurry at the same time, either as a mixture or simultaneously but separately.

The strength composition may be added to the fibre slurry before the formation of the paper or board web. The strength composition or its separate components, i.e. the permanent wet strength resin component and the sizing agent may be added during the preparation of the fibre slurry, for example into a suction pump of the mixing chest or into the never-dried pulp flow. The strength composition may be added also into a pulper, or a mixing tank.

The never-dried fibres may also be treated with the strength composition comprising the permanent wet strength resin and the sizing agent before the never-dried fibres are combined with optional other fibre material and/or fillers for formation of the fibre slurry. Examples of such other fibre materials are recycled fibres, fibres originating from broke, dried fibres and/or fibres produced by mechanical pulping. Alternatively one of the separate components of the strength composition, i.e. the permanent wet strength resin component or sizing agent, preferably the wet strength resin component, is added to the never-dried fibres before its combination with other fibre material and/or filler(s). In these cases the formed fibre slurry may also be additionally treated with the strength composition after its formation.

In a preferred embodiment the permanent wet strength resin component is added to the never-dried fibres before formation of the fibre slurry, i.e. before the combination with the optional other fibre material and/or filler(s). The permanent wet strength resin component is allowed to interact with the never-dried fibres, thus providing treated never-dried fibres. The sizing agent is added to the formed fibre slurry comprising treated never-dried fibres, optional other fibre material and/or filler(s).

The fibre slurry treated with the strength composition is formed into a paper or a board web, typically by using a Fourdrinier machine, comprising at least a forming section and press section. In the beginning of the forming section the fibre slurry is introduced from a headbox on a forming fabric, which is a woven, endless fabric, through which water is drained from fibre slurry with the help of various dewatering elements. The fabric functions as filtration medium and as a smooth support base for the fibre slurry flowing from the headbox. At the same time, the moving endless fabric also transfers the web from the headbox to the press section. In the forming section of a modern paper machine, there are often two separate forming fabrics, arranged to work together either as a gap former or as a hybrid former. Forming sections of board machines may usually comprise of several fabrics and head-boxes for formation of different board layers.

According to one embodiment a defoaming agent may be added to the fibre slurry. The defoaming agent may be added before the addition of the strength composition. The defoaming agent may be selected from silica based defoaming agents and defoaming agents based on fatty alcohols. Typically the defoaming agent is added in amount of 200-500 g/ton of dry fibre slurry, preferably 200-300 g/ton of dry fibre slurry, more preferably 200-250 g/ton of dry fibre slurry.

According to one embodiment the paper or board product having improved dimensional stability is provided, wherein the paper or board product is prepared from a fibre slurry comprising never-dried fibres and a strength composition comprising a permanent wet strength resin component and a sizing agent. The paper or board product has preferably a wet expansion, as measured according to EMCO (15 min), reduced by at least 10%, more preferably by at least 15%, most preferably by at least 20% compared to a paper or board product not comprising said strength composition.

Hereafter, the present invention is described in more detail and specifically with reference to the examples, which are not intended to limit the present invention.

EXAMPLES

Some embodiments of the invention are described in the following non-limiting examples.

Chemicals and Properties of the Pulp

Table 1 shows properties of the pulp used in the examples.

TABLE 1

Properties of pulp.

| Properties | Pulp 1 |
|---|---|
| Cationic Demand measured by Mutek Particle Charge Detector (μeq/l) | −907 |
| Conductivity (ms/cm) | 5.00 |
| Alkalinity (mg/L) | 600 |
| Hardness (mg/L, $CaCO_3$) | 900 |

It can be concluded from Table 1 that used Pulp 1 has high alkalinity and hardness.

Tested strength resin components were as follows:

Strength resin 1: wet strength resin, polyamidoamine-epihalohydrin resin, Kemira Oyj, Finland Comparative resin 2: G-PAM from Kemira Oyj, Finland Comparative resin 3: anionic dry strength polyacrylamide from Kemira Oyj, Finland Comparative resin 4: cationic dry strength polyacrylamide from Kemira Oyj, Finland As the sizing agent a rosin derivative size from Kemira Oyj, Finland was used.

Example 1

Zeta potential and capability of the fibres to retain strength resin components was evaluated first. Zeta potential values were evaluated at various strength resin component and sizing agent dosages to confirm the adding dosage limits. Table 2 shows the obtained results.

TABLE 2

| Strength Resin component (kg/t, active) | | Sizing Agent (kg/t, active) | PCD (ueq/L) | Zeta potential (mV) |
|---|---|---|---|---|
| Blank | 0 | 0 | −914 | −14.0 |
| Blank | 0 | 6 | −722 | −12.6 |
| strength resin 1 | 2 | 0 | −940 | −13.8 |
| strength resin 1 | 2 | 6 | −588 | −13.0 |
| strength resin 1 | 4 | 0 | −824 | −13.4 |
| strength resin 1 | 4 | 6 | −580 | −13.2 |
| comparative resin 2 | 2 | 0 | −916 | −14.0 |
| comparative resin 2 | 2 | 6 | −498 | −13.5 |
| comparative resin 2 | 4 | 0 | −874 | −13.8 |
| comparative resin 2 | 4 | 6 | −566 | −13.3 |
| comparative resin 2 + comparative resin 3 | 2 + 2 | 0 | −996 | −14.6 |
| comparative resin 2 + comparative resin 3 | 2 + 2 | 6 | −829 | −13.6 |
| comparative resin 2 + comparative resin 3 | 4 + 2 | 0 | −1220 | −14.1 |
| comparative resin 2 + comparative resin 3 | 4 + 2 | 6 | −842 | −13.5 |
| comparative resin 4 | 2 | 0 | −1025 | −13.0 |
| comparative resin 4 | 2 | 6 | −592 | −14.7 |
| comparative resin 4 | 4 | 0 | −912 | −10.2 |
| comparative resin 4 | 4 | 6 | −522 | −11.4 |

From Table 2, it can be seen that with the increasing dosage of strength resin components, the Zeta potential of the pulp becomes less negative.

Hand sheet simulation was conducted for dry & wet strength property evaluation as well as wet expansion and hydrophobicity. Table 3 lists the detailed conditions for the simulation.

TABLE 3

| Pulp | Pulp 1, see Table 1 | |
|---|---|---|
| Chemicals | Wet strength resin component, kg/t | 2.4 |
| | Additional Strength agent, active dosage, kg/t | 0.2 |
| | Sizing agent, active dosage, kg/t | 0.6 |
| | $Al_2(SO_4)_3$, dry dosage, kg/t | 26 |
| Hand sheet | Retention, kg/t | 0.2 |
| | Base weight, gsm | 100 |
| | Automatic formation | Yes |
| | Automatic drying | 93° C., 6 min |
| Performance check | Dry tensile index | Yes (Climate room 23 C. 50% Humidity) |
| | Wet tensile index | |
| | Burst | |
| | Wet expansion at 15 mins | |
| | W/D % | |
| | Cobb 60 | |

Various dosages of wet and dry strength resins components based on the dry pulp quantity were added. Handsheets with and without strength resin components and sizing agent were made as follows.

The original deflaked pulp 1 was diluted into 1 weight-% concentration with white water under agitation. The prepared pulp slurry was first agitated at about 500 rpm for 15 seconds, and then the used chemicals were dosed with an interval of 15 seconds each. After dosing of the last chemical, the mixing of the pulp slurry was continued for 15 seconds. Handsheets, having a basis weight of 100 g/m$^2$, were produced on a handsheet maker machine. Handsheets were dried in automatic drying chambers of handsheet maker machine for 6 minutes at the temperature of 93° C. and vacuum of 96 kPa to rapidly remove the moisture.

Before testing of the strength properties of the produced handsheets, i.e. dry tensile index, dry tensile index, burst index, wet expansion and Cobb60 value, the sheets were pre-conditioned for 24 h at 23° C. in 50% relative humidity according to standard ISO 187. Devices and standards, which were used to measure the properties of the sheets, are given in Table 4.

TABLE 4

Sheet testing devices and standards

| Measurement | Device | Standard |
|---|---|---|
| Hand sheet making | Estanit Rapid Köthen hand sheet maker | ISO 5269-2-2004 |
| Wet tensile index | Thwing-Albert vertical tensile tester | GB/T 12914-2008 |
| Dry tensile index | Thwing-Albert vertical tensile tester | GB/T 12914-2008 |
| Burst index | L&W Bursting Strength Tester | |
| Wet expansion | Water bath | EMCO |
| Cobb60 | L&W Cobb Sizing Tester | ISO 535, T441 |

The obtained strength properties of the produced handsheets are shown in Table 5.

From the results of Table 5, the strength resin 1 shows very good response to wet tensile and also good response to wet expansion. For dry tensile index, the difference of sheets with treatment of various strength resins is not big; while for wet tensile index, strength resin 1 performs better than the others. And the extra effect of rosin size is probably, without bounding to any theory, due to reduced wetting.

For burst, all the data are quite similar; but for wet expansion, strength resin 1 does have positive effect, reducing the rate of wet expansion of the sheets.

It was also surprisingly found, based on the results, without bounding to any theory that good hydrophobicity can also contribute to reduced wet expansion. Therefore, both wet strength reagent and surface size are needed to enforce the effect. Cobb60 value is also evaluated at different dosages. Strength resin 1 performs well when cooperating with rosin size.

TABLE 5

Properties of sheets with combinations of various strength resins and rosin size.

| Strength resin (kg/t, active) | | Rosin size (kg/t, active) | Dry tensile index (N · m/g) | Wet tensile index (N · m/g) | Burst index (kpa · m2/g) | Wet expansion (%, 15 mins) | W/D % | Cobb60 |
|---|---|---|---|---|---|---|---|---|
| Blank | 0 | 0 | 45.88 | 2.16 | 2.84 | 1.08 | 4.70 | 220.4 |
| Blank | 0 | 6 | 45.79 | 2.56 | 2.79 | 1.13 | 5.59 | 82.5 |
| strength resin 1 | 2 | 0 | 47.73 | 4.93 | 2.89 | 0.89 | 10.33 | 195.9 |
| strength resin 1 | 2 | 6 | 42.00 | 4.85 | 2.75 | 0.94 | 11.55 | 47.3 |
| strength resin 1 | 4 | 0 | 41.47 | 7.26 | 2.91 | 0.92 | 17.50 | 172.5 |
| strength resin 1 | 4 | 6 | 44.16 | 8.04 | 2.90 | 0.94 | 18.20 | 37.0 |
| comp. resin 2 | 2 | 0 | 41.81 | 3.38 | 2.93 | 1.27 | 8.09 | 233.3 |
| comp. resin 2 | 2 | 6 | 43.58 | 3.28 | 2.89 | 1.06 | 7.53 | 109.1 |
| comp. resin 2 | 4 | 0 | 41.78 | 3.77 | 2.87 | 1.10 | 9.01 | 211.4 |

TABLE 5-continued

Properties of sheets with combinations of various strength resins and rosin size.

| Strength resin (kg/t, active) | | Rosin size (kg/t, active) | Dry tensile index (N · m/g) | Wet tensile index (N · m/g) | Burst index (kpa · m2/g) | Wet expansion (%, 15 mins) | W/D % | Cobb60 |
|---|---|---|---|---|---|---|---|---|
| comp. resin 2 | 4 | 6 | 45.65 | 3.35 | 2.95 | 0.98 | 7.33 | 99.1 |
| comp. resin 2 + comp. resin 3 | 2 + 2 | 0 | 41.20 | 3.15 | 2.78 | 1.10 | 7.66 | 194.5 |
| comp. resin 2 + comp. resin 3 | 2 + 2 | 6 | 45.08 | 2.83 | 2.99 | 1.26 | 6.29 | 124.8 |
| comp. resin 2 + comp. resin 3 | 4 + 2 | 0 | 42.57 | 3.34 | 2.96 | 1.13 | 7.85 | 188.2 |
| comp. resin 2 + comp. resin 3 | 4 + 2 | 6 | 46.81 | 4.06 | 3.04 | 0.98 | 8.68 | 59.4 |
| comp. resin 4 | 2 | 0 | 41.71 | 2.27 | 2.42 | 1.08 | 5.44 | 186.0 |
| comp. resin 4 | 2 | 6 | 40.13 | 3.76 | 2.77 | 1.01 | 9.38 | 45.9 |
| comp. resin 4 | 4 | 0 | 43.21 | 2.73 | 2.80 | 1.05 | 6.32 | 225.1 |
| comp. resin 4 | 4 | 6 | 46.37 | 5.13 | 3.05 | 1.43 | 11.06 | 36.9 |

The invention claimed is:

1. A method for producing of a paper or a board product comprising:

providing never-dried fibres;

providing a strength composition comprising a permanent wet strength resin component and a sizing agent;

adding the permanent wet strength resin component to the never-dried fibres, thus providing treated never-dried fibres;

combining the treated never-dried fibres with a fibre material selected from recycled fibres, fibres originating from broke, dried fibres and/or fibres produced by mechanical pulping, thus providing a fibre slurry comprising 15-70 weight-% of the treated never-dried fibres, based on a total dry weight of the fibre slurry;

forming a treated fibre slurry by treating the never-dried fibres with the sizing agent of the strength composition before the combining step or treating the fibre slurry with the sizing agent of the strength composition;

introducing the treated fibre slurry to a forming section to produce a web; and introducing the web into a press section for producing a paper or a board product.

2. The method according to claim 1, wherein the paper product is paper selected from gypsum paper; wall paper; coated paper; printing paper; copy paper, or the board product is selected from gypsum board, coated board and glued board.

3. The method according to claim 1, wherein the amount of the never-dried fibres in the fibre slurry is 30-70 weight-%, based on the total dry weight of the fibre slurry.

4. The method according to claim 3, wherein the amount of the never-dried fibres in the fibre slurry is 40-60 weight-%, based on the total dry weight of the fibre slurry.

5. The method according to claim 1, wherein the never-dried fibres are unbleached or bleached Kraft fibres.

6. The method according to claim 1, wherein the permanent wet strength resin component is selected from polyamidoamine-epihalohydrin (PAE) resins, polydiisocyanate resins, urea-formaldehyde (UF) resins, melamine formaldehyde (MF) resins, polydiisocyanate (DI) resins and mixtures thereof.

7. The method according to claim 6, wherein the polyamidoamine-epihalohydrin resin has a molar ratio of epihalohydrin to secondary amine group of at least 0.8 to 3.0.

8. The method according to claim 6, wherein the polydiisocyanate resin comprises aliphatic, cycloaliphatic or aromatic polydiisocyanates, or mixtures thereof.

9. The method according to claim 6, wherein the polydiisocyanate resin is based on diphenylmethane diisocyanate, toluene diisocyanate, hexamethylene diisocyanate, isophorone diisocyanate chemistry, or a mixture thereof.

10. The method according to claim 1, wherein the sizing agent is selected from alkylene ketene dimer (AKD), alkyl succinic anhydride (ASA), rosin derivative, or a mixture thereof.

11. The method according to claim 1, wherein the permanent wet strength resin component and the sizing agent of the strength composition are added separately to the never-dried fibres.

12. The method according to claim 11, wherein the permanent wet strength resin component is added prior to the addition of the sizing agent.

13. The method according to claim 11, wherein the sizing agent is added prior to the addition of the permanent wet strength resin component.

14. The method according to claim 1, wherein the permanent wet strength resin component and the sizing agent are added simultaneously to the never-dried fibres.

15. The method according to claim 1, wherein the strength composition is added in such amount that zeta potential of the fibre slurry remains negative, after addition of the strength composition.

16. The method according to claim 1, wherein the permanent wet strength resin component is added in an amount of 0.1-30 kg of permanent wet strength resin component/ton dry fibre slurry, calculated as dry permanent wet strength resin.

17. The method according to claim 1, wherein the sizing agent is added in an amount providing to the paper or board a Cobb60 value of at most 70 $g/m^2$, as measured according to ISO 535.

18. A paper or a board product having improved dimensional stability, wherein the paper or board product is produced by a method according to claim 1, and has a wet expansion, as measured according to EMCO (15 minutes), reduced by at least 10% compared to a paper or board not comprising a strength composition comprising a permanent wet strength resin component and a sizing agent.

19. The paper or board product according to claim 18, wherein the paper or board product has a Cobb60 value of at most 70 $g/m^2$, as measured according to ISO 535.

20. The paper or the board product according to claim 18, wherein the paper or the board product has a wet expansion, as measured according to EMCO (15 minutes), reduced by at least 15% compared to a paper or board not comprising a strength composition comprising a permanent wet strength resin component and a sizing agent.

* * * * *